United States Patent [19]

McIntyre

[11] Patent Number: 4,650,151

[45] Date of Patent: Mar. 17, 1987

[54] SUBSEA GATE VALVE ACTUATOR WITH EXTERNAL MANUAL OVERRIDE AND DRIFT ADJUSTMENT

[75] Inventor: John N. McIntyre, Spring, Tex.

[73] Assignee: FMC Corporation, Chicago, Ill.

[21] Appl. No.: 746,001

[22] Filed: Jun. 18, 1985

Related U.S. Application Data

[63] Continuation of Ser. No. 456,957, Jan. 10, 1983, abandoned.

[51] Int. Cl.[4] ..... F16K 31/12

[52] U.S. Cl. ..... 251/14; 251/63.5; 251/187; 251/367; 251/62; 137/81.2; 137/236.1; 92/161

[58] Field of Search ..... 251/14, 191, 267, 291, 251/556, 165, 128, 285, 367, 60, 62, 63.6, 63.5, 158, 193, 187; 137/81.2, 556, 236 S; 92/161, 146; 403/44, 43, 45; 285/175; 239/417, 416

[56] References Cited

U.S. PATENT DOCUMENTS

| | | | |
|---|---|---|---|
| 489,799 | 1/1893 | Ford | 251/14 |
| 535,314 | 3/1895 | Bartlett et al. | 403/44 |
| 978,860 | 12/1910 | Dietz | 239/416 |
| 1,341,319 | 5/1920 | Hodges | 251/14 |
| 1,433,139 | 10/1922 | Lolton | 251/293 X |
| 1,621,509 | 3/1927 | Humason et al. | 239/417 |
| 1,781,091 | 11/1930 | Wilson | 285/175 |
| 2,094,288 | 9/1937 | Zinkil et al. | 251/265 X |
| 2,542,390 | 2/1951 | Brown | 251/267 X |
| 2,596,532 | 5/1952 | Coolidge et al. | 251/291 X |
| 2,622,617 | 12/1952 | Sederquist | 251/14 |
| 2,667,892 | 2/1954 | Gentzel | 251/14 X |
| 2,698,157 | 12/1954 | Ludeman | 251/14 |
| 3,081,116 | 3/1963 | Weiner et al. | 403/44 |
| 3,282,227 | 11/1966 | Nielson | 239/417 X |
| 3,290,003 | 12/1966 | Kessler | 251/291 X |
| 3,379,405 | 4/1968 | Natho | 251/63.6 X |
| 3,402,912 | 9/1968 | Watkins | 251/14 |
| 3,466,001 | 9/1969 | Nelson | 251/63.6 X |
| 3,913,883 | 10/1975 | Irwin | 251/63.6 X |
| 4,135,547 | 1/1979 | Ackkerman et al. | 137/315 |
| 4,180,239 | 12/1979 | Valukis | 251/60 |
| 4,213,480 | 9/1980 | Orum et al. | 251/267 X |
| 4,231,389 | 11/1980 | Still et al. | 251/291 X |
| 4,289,294 | 9/1981 | McLean | 251/14 X |
| 4,436,279 | 3/1984 | Bonds et al. | 251/63.6 X |
| 4,444,220 | 4/1984 | Seger | 251/214 X |
| 4,483,509 | 11/1984 | Lewcock et al. | 251/158 X |

FOREIGN PATENT DOCUMENTS

| | | | |
|---|---|---|---|
| 442659 | 9/1945 | Italy | 251/191 |
| 1436749 | 5/1976 | United Kingdom | 251/14 |
| 1604339 | 12/1981 | United Kingdom . | |

*Primary Examiner*—Samuel Scott
*Assistant Examiner*—Carl D. Price
*Attorney, Agent, or Firm*—W. William Ritt, Jr.; Richard B. Megley

[57] ABSTRACT

A hydraulically operated actuator for a sliding gate valve designed for use in a subsea environment. The actuator includes a manual override system that functions independently of the actuator's hydraulic piston and return spring, an externally accessible valve gate drift adjustment, an externally adjustable upstop for the actuator stem, a stem thread assembly that can be manufactured from a material different from the actuator stem to prevent or reduce the possibility of thread galling, a hydraulic control pressure porting system integral with the hydraulic cylinder to minimize space requirements, and a facility for accommodating an optional external electrical stem position indicator package.

5 Claims, 3 Drawing Figures

SUBSEA GATE VALVE ACTUATOR WITH EXTERNAL MANUAL OVERRIDE AND DRIFT ADJUSTMENT

This application is a continuation of application Ser. No. 456,957 filed Jan. 10, 1983 and now abandoned.

BACKGROUND OF THE INVENTION

This invention relates to gate valve actuators, and more particularly to hydraulically operated actuators for subsea well gate valves.

For some time the oil and gas industry has required hydraulic actuators for operating gate valves on subsea well christmas trees, pipe manifolds, and other underwater well apparatus, and such actuators of various designs are in widespread use for this purpose. Preferably, an actuator for this type of service would be capable of manual operation in the event of hydraulic power failure, would have provision for external adjustment to compensate for valve gate drift, could be manually operated and adjusted with readily available tools and minimal effort, and would be compact in size and functionally reliable.

SUMMARY OF THE INVENTION

The present invention is embodied in a hydraulic operated gate valve actuator having one or more of the above features. Such an actuator can include an externally adjustable valve gate drift adjustment system, a manual override system that does not exercise the hydraulic piston or its return spring at any time during the manual override operation, thereby requiring the application of only minimal actuation torque by the diver, and that does not introduce a potential leakpath to control pressure fluid during said override cycle, an externally adjustable upstop for the actuator stem that can be used instead of the backseat between the valve stem and bonnet, and a separate and readily replaceable thread assembly for the actuator stem that offers reduced manufacturing costs and less potential for thread galling during the actuator's service life.

The actuator has a high spring load-to-actuation piston area ratio with multiple control ports for more rapid response to command control pressure. Should the control pressure fail the spring automatically and quickly returns the piston to its "valve closed" position, thereby providing effective fail-safe closed protection to the fluid conduit in which the valve is installed.

In its preferred form the actuator also includes a hydraulic control pressure porting system that is integral to the cylinder to minimize external plumbing requirements and the overall length and diameter of the actuator. A manifolding hydraulic distribution system for the control pressure porting assures positive distribution of fluid to the cylinder during actuation, and minimizes the number of fabricated parts in the system.

In its preferred form the actuator further includes an ambient pressure compensation porting system on the backside of the piston and piston cylinder to almost equalize the pressure in the static non-operating mode control pressure porting system caused by hydrostatic hydraulic head from sea level to the installed subsea valve. This compensation system assures that the actuator is only operated to the open position by a positive control pressure command from the surface control system, and not by hydrostatic head pressure in the control pressure porting system.

The preferred form of actuator additionally includes an accommodation for an externally mounted electrical position indication package for monitoring the position of the actuator stem and, ultimately, the valve gate to which the stem is connected. Provision for manually monitoring the stem and gate positions, from outside the actuator, also is present in the preferred embodiment in a form that is readily accessible to a diver.

DESCRIPTION OF THE PREFERRED EMBODIMENT

Figure 1:
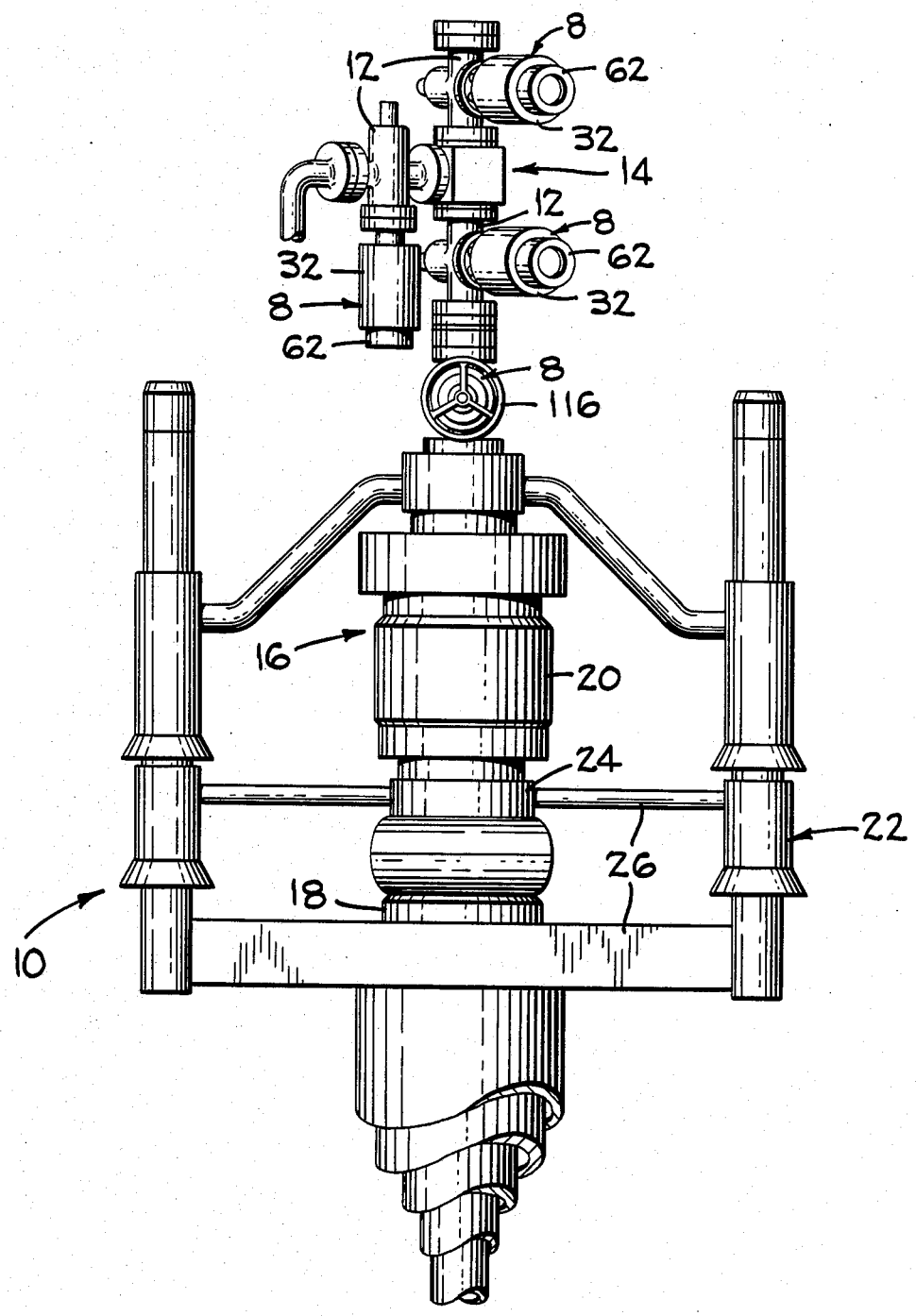
FIG. 1 is a diagrammatic side elevation of a subsea well completion system, showing valve actuators incorporating the present invention in functional position on gate valves of a subsea christmas tree.

As diagrammatically represented in FIG. 1, valve actuators 8 embodying the present invention are especially suitable for use on subsea well completion apparatus 10 to open and close gate valves 12 located in the christmas tree 14 that is mounted on the subsea wellhead assembly 16. The illustrated wellhead assembly 16 typically includes a wellhead housing 18, a tree connector 20 securing the tree 14 to the housing 18, and a permanent guide base 22 surrounding and secured to the housing 18 and associated wellhead components 24 by support struts 26. The actuators 8 are operated by hydraulic pressure conducted from a suitable source (not shown) through hydraulic lines (not shown), and the pressure is applied to the actuator pistons through internal passages in the actuator as described below.

Figure 2:
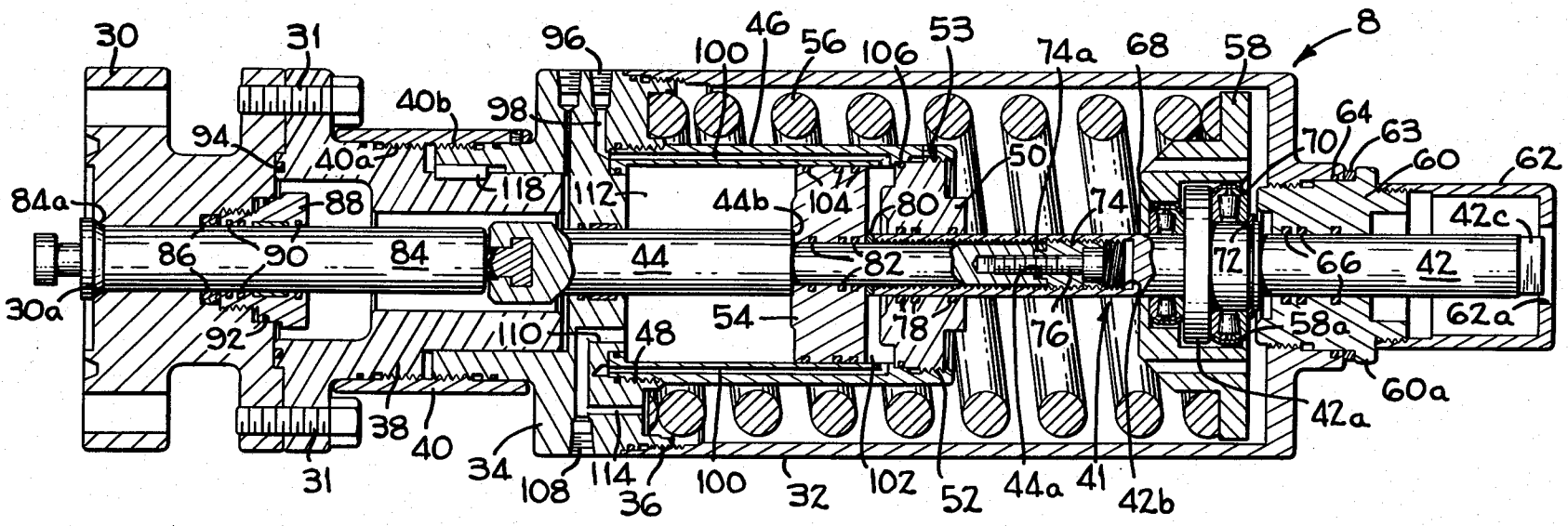
FIG. 2 is a central longitudinal section, on an enlarged scale, of a valve actuator that includes the features of the present invention.
Figure 3:
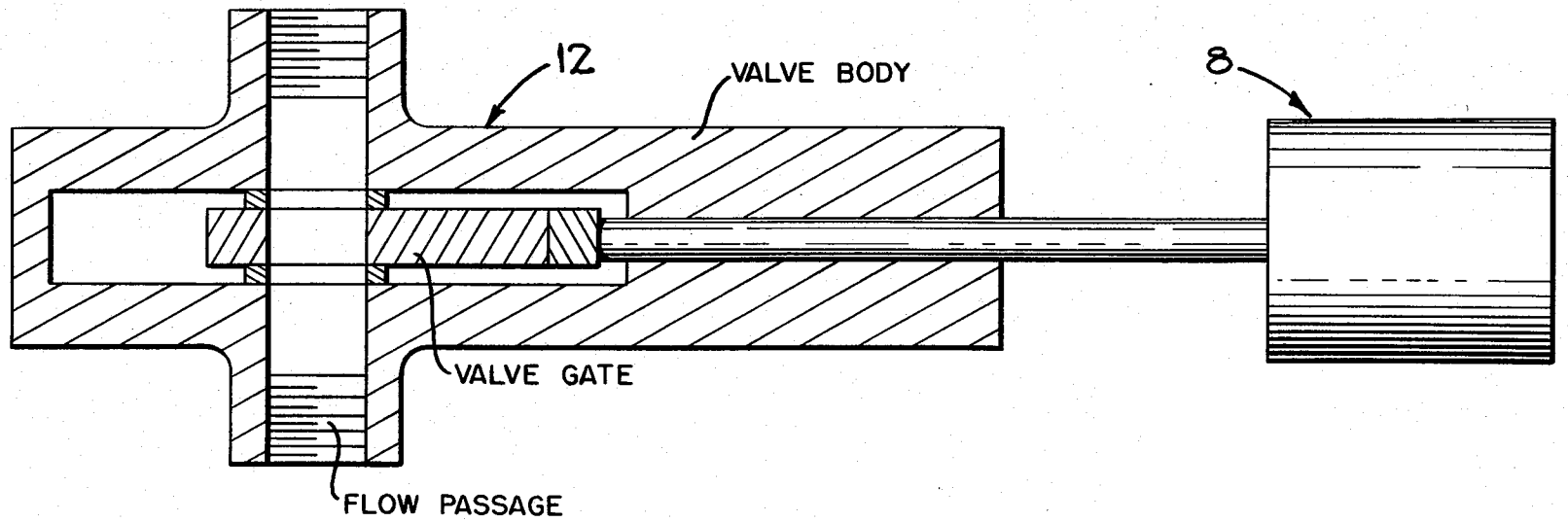
FIG. 3 is a diagrammatic illustration of a gate valve, having a flow passage and a valve actuator connected to the valve stem.

Referring to FIG. 2, the preferred embodiment of the present invention is illustrated in one of the valve actuators 8 that is shown attached to the bonnet 30 of one of the gate valves 12 by a plurality of screws 31. The actuator 8 broadly comprises a housing 32 secured to a main body 34 by threads 36, a flange body 38 connected to the main body 34 by a flange body collar 40, a stem assembly 41 comprising an outer or manual override stem 42 and an inner or actuation cylinder stem 44, a sleeve-type hydraulic cylinder 46 secured by threads 48 to the main body 34, a cylinder cap 50 secured by threads 52 and a set screw 53 to the cylinder 46, a piston 54 mounted on the inner stem 44 within the cylinder 46, and a piston-return coil spring 56 surrounding the cylinder 46 and extending between the main body 34 and a spring compression hub 58 that surrounds the outer stem 42.

The outer end of the housing 32; i.e., the righthand end as viewed in FIG. 2, has a central opening into which is threaded a packing gland 60, and threaded onto the outer end of the packing gland is an end cap 62 with a central opening **62*a*. The outer stem 42 extends through the packing gland 60 and into the end cap 62, preferably terminating within the central opening 62*a* when the stem is in its "valve closed" position shown in FIG. 2. Between a radial flange 60*a* of the packing gland 60 and the adjacent end face of the actuator housing 32 is a spacer ring 63 that is removed to facilitate further threading of the gland into the housing to provide a stop for the actuator stem, as will be more fully explained later. An annular static seal 64 provides fluid-tight integrity between the gland 60 and the housing 32, and annular dynamic seals 66 provide a fluid barrier between the gland and the actuator's outer stem 42**.

The outer stem 42 has a radially enlarged area or flange 42*a* located within a central bore 58*a* of the hub 58, and a pair of bearing assemblies 68, 70, located on opposite sides of the flange 42*a*, provide relative rotation support between the stem 42 and the hub 58. A retainer ring 72 holds the bearing assembly 70 in position against the stem flange 42*a*.

The outer stem 42 is connected to the inner stem 44 by means of a stem adjustment screw 74 that is secured to the end of the inner stem by a cap screw 76. The inner end of the stem adjustment screw 74 has a central transverse tongue 74*a* that cooperates with a mating groove 44*a* in the adjacent end of the inner stem 44 to prevent relative rotation between the screw 74 and the stem 44 when properly assembled as shown. The adjustment screw 74 and the adjacent portion ot the inner stem 44 reside in a central threaded bore 42*b* in the outer stem 42, and external threads on the screw 74 cooperate with the threads in the bore 42*b* to axially change the location of the screw in the bore, and thus the axial position of the inner stem 44 with respect to the outer stem 42, when the outer stem is rotated with respect to the inner stem.

The outer stem 42 extends through a central bore in the cylinder cap 50 and is sealed in a fluid-tight manner thereto by annular dynamic seals 78. Between the inner end of the outer stem 42 and the piston 54 is an annular bushing 80 to prevent galling of the adjacent piston face by the stem 42 when the stem is rotated with respect to the inner stem 44 into the position shown in FIG. 2. When in that position the outer stem 42 holds the piston 54 against an annular shoulder 44*b* on the inner stem 44, and when the actuator is operated by hydraulic pressure the piston 54, inner stem 44 and outer stem 42 translate in unison. Annular seals 82 assure a fluid-tight barrier between the piston and the inner stem.

When the actuator 8 is functionally connected to a gate valve the actuator's inner stem 44 is connected to the valve's bonnet stem 84 by suitable means such as the T-slot arrangement shown in FIG. 2, so that when the actuator is operated the stems 44, 84 translate in unison. The other end portion of the valve bonnet stem 84 includes an annular beveled shoulder 84*a* that cooperates with an annular beveled backseat surface 30*a* on the valve bonnet 30 to establish a metal-to-metal seal between the stem 84 and the bonnet when the valve is closed as shown in FIG. 2. An annular packing 86, held in place in the bonnet 30 by a packing retainer nut 88, provides a dynamic seal between the bonnet and the bonnet stem 84, and annular dynamic seals 90 provide a fluid-tight barrier between the stem 84 and the packing nut 88. The packing nut 88 is sealed to the bonnet 30 by an annular seal element 92, and an annular seal 94 provides fluid-tight integrity between the bonnet and the actuator main body 34.

HYDRAULIC OPERATION

The valve actuator 8 is designed for hydraulic operation but is provided with manual override capability when required. When operated hydraulically, control pressure is introduced through one or more ports 96 (only one shown) and conducted by an annular manifold 98 to and through a plurality of circumferentially spaced longitudinal passageways 100 in the wall of the cylinder 46 into an annular chamber 102 between the piston 54 and the cylinder cap 50. Annular seals 104 between the piston and the cylinder and 106 between the cylinder cap and the cylinder cooperate with the seals 78, 82 to confine actuation control pressure to the chamber 102, whereby in response to this pressure the piston, the actuator stem assembly 41 and the valve bonnet stem 84 translate in unison to the left as viewed in FIG. 2, unseating the bonnet stem shoulder 84*a* from the bonnet backseat 30*a* and translating the valve gate (not shown) into its open position.

Pressure compensation for the actuator 8 to ease its operation at deep sea depths is provided by an external compensator (not shown) that is functionally connected to one or more ports 108 (only one shown) in the actuator main body 34. Compensated oil pressure entering port 108 is conducted by a passageway 110 into an annular chamber 112 in the cylinder 46 and in front of the piston 54, and also by a passageway 114 into the spring housing 32. This pressure compensation precludes external hydrostatic pressure from crushing the housing 32 and rendering the actuator inoperable.

The actuator spring 56 functions to automatically close the valve whenever control pressure is lost or removed from the backside of the piston 54. The spring 56 provides a force sufficient to rapidly overcome the hydrostatic head of the control pressure column situated above the water surface; i.e., platform control room height above the water. Since the above-described pressure compensation system eliminates the effect of the ambient water pressure on the actuator, which pressure can be very great depending upon the depth at which the actuator is located, the size of the spring 56 required to close the valve is substantially less than if such pressure compensation were absent.

When the actuator is hydraulically operated by control pressure command the outer stem 42 moves from its illustrated "valve closed" position towards the valve bonnet 30, carrying with it the spring compression hub 58 and the bearing assemblies 68, 70. This movement of the hub 58 compresses the actuator spring 56 which remains compressed as long as the valve remains open. This movement ot the outer stem 42 also results in relocation of the stem's outer end face 42*c*, so that the position of the stem, and thus the position of the valve gate, can be manually ascertained from the outside of the actuator through the end cap opening 62*a*.

MANUAL OVERRIDE OPERATION

The present invention provides manual override operation of the valve operator 8, even under valve operating pressure or hydraulic system control pressure, by removing the end cap 62, installing a wheel crank 116 (FIG. 1) on the outer stem 42, and then rotating the stem. As the stem 42 rotates the stem adjustment screw 74 is forced to the left (FIG. 2); i.e., towards the valve bonnet 30, thereby translating the inner stem 44, the bonnet stem 84, and the valve gate (not shown) to the left to open the valve. During this valve opening rotation the operation resultant forces from the stems 44 and 84 and the valve gate are reacted through the bearing assembly 70 by the stem 42, and the bearing assembly 70 is reacted by the packing gland 60.

It should be noted that the manual override feature of the present invention enables the stems 44 and 84, and of course, also the valve gate, to translate without exercising the piston 54, the spring 56 or the spring compression hub 58. Because of this, significantly less torque is required to manually open the valve, and thus an important advantage is achieved as compared with operation requiring spring compression.

When using the manual override to close the valve from its open position, the stem 42 is rotated by the wheel crank 116 in the opposite direction. This rotation causes the stem adjustment screw 74 to move to the right; i.e., towards the packing gland 60, thereby pulling the stems 44 and 84 and the valve gate in the same direction, and resulting in closing the valve. During this valve-closing rotation the operation resultant forces from the valve gate and the stems 84 and 44 are reacted through bearing assembly 68 by the stem 42. Also during this valve-closing the bearing assembly 68 is reacted by the spring compression hub 58, and the hub is reacted by the spring 56.

It should be noted that the retainer ring 72, which retains the bearing assembly 70 on the outer stem 42, is required for normal hydraulic operation of the actuator 8 when the stem 42, hub 58 and spring 56 cycle forward and aft many times during normal actuation of a subsea valve by control pressure command.

EXTERNAL ADJUSTMENTS

The present invention further provides for externally adjusting the position of the valve gate to which the actuator 8 is connected.

External adjustment of valve gate drift is accomplished by rotating the flange collar 40 either clockwise or counterclockwise. The collar 40 has two sets of internal threads **40*a*, 40*b*, one right-hand and the other left-hand, that engage external threads on the flange body 38 and the main body 34. Relative rotation of the bodies 38, 34 is prevented by an anti-rotation key 118 that resides in opposed keyway slots in the adjacent body surfaces. Accordingly, rotation of the collar 40 either draws the main body 34 and the housing 32 towards the flange body 38 or forces them away from the body 38, thereby changing the position of the bonnet stem 84 and the actuator's inner stem 44 with respect to the actuator cylinder 46**, and thus changing the drift; i.e., the valve gate position with respect to the valve body/bonnet/actuator assembly.

External stop adjustment for the stems 42, 44, 84 and the valve gate is accomplished by rotation of the packing gland 60. Thus, if it is desired to stop closing movement of these stems and the gate before the stem shoulder **84*a* backseats on the bonnet surface 30*a*, the frangible spacer ring 63 is knocked out and the gland 60 is threaded further into the housing 32** until its axial position stops the movement at the desired point.

The ability to achieve these two adjustments from outside the actuator offers significant cost savings in assembly adjustment, both in the shop and in the field, as well as adjustment when in a subsea location.

VALVE GATE POSITION INDICATION

As discussed above, the present invention facilitates determination of the position of the valve gate by viewing or feeling/measuring the relative position of the outer stem 42 to the end cap 62. A fully extended stem indicates the valve gate is closed, and of course a fully retracted stem indicates the valve gate is in its open position.

The invention also envisions determination of the valve gate position by electrical means, such as by an external electrical sensor (not shown) mounted on the end cap 62. Using a permanently magnetized stem 42, the proper sensor can determine the presence (valve closed position) of the stem or the non-presence (valve open position) thereof, and send an appropriate signal to the control room on the surface platform (not shown).

It should further be noted that although the above-described valve actuator is intended for use on gate valves on subsea well completion christmas trees and/or manifolds, the actuator also has utility on shore where remote operation of gate valves is required. Thus the adjustment features described above offer an economic advantage where valve adjustments are required in the field, either on land or subsea.

Although the best mode contemplated for carrying out the present invention has been herein shown and described, it will be apparent that modification and variation may be made without departing from what is regarded to be the subject matter of the invention.

What is claimed is:

1. A fluid powered actuator for a sliding gate valve comprising a valve body with a flow passage therethrough, a bonnet connected to said body, a valve gate in said body, said valve gate having a flow passage therethrough, and a valve stem connected to said gate and extending through said bonnet, said actuator comprising:

(a) a housing with first and second opposed closed ends;

(b) a fluid cylinder within said housing and having an end portion;

(c) a fluid-powered piston arranged to reciprocate within said cylinder for actuating said valve;

(d) an actuator stem connected to said piston and extending through both of said opposed ends, said actuator stem comprising a first stem element extending from said piston through said first opposed housing end and terminating in a means for releasably connecting said actuator stem to said valve stem, a second stem element extending from said piston through said cylinder end portion and said second opposed housing end and terminating in a means for rotating said second stem element with respect to said first stem element, stop means on said second stem element cooperating with said second opposed housing end to limit axial movement of said second stem element, and threaded means adjustably interconnecting said first and second stem elements in and end-to-end manner, said threaded means comprising an externally threaded annular spacer releasably secured to one end of said first stem element and an internally threaded bore in said second stem element, said spacer and said bore cooperating to cause relative axial movement between said first and second stem elements when said second stem element is rotated with respect to said first stem element;

(e) means on said valve stem for cooperating with said releasably connecting means on said actuator stem for releasably connecting and disconnecting said actuator stem to said valve stem while the valve is under operating pressure; and (f) means for connecting and disconnecting said housing to and from said valve bonnet while the valve is under operating pressure and for adjusting the position of the valve gate flow passage relative to the valve body flow passage, said connecting and disconnecting means comprising an annular flange body and a sleeve-like collar, said collar connected to the housing by first thread means and connected to said flange body by second thread means, said first and second thread means constituting a differential thread system so that rotation of said collar with respect to said housing and said flange body will change (1) the axial spacing between the housing and the flange body and (2) the position of the valve gate with respect to the valve body and the bonnet.

2. An actuator according to claim 1 wherein the first and second thread means are of opposite hand.

3. An actuator according to claim 1 wherein the actuator stem includes manual override means for manually operating the actuator without advancing the piston.

4. An actuator according to claim 3 including means for biasing the piston and the actuator stem in one axial direction, and wherein the manual override means functions without exercising said biasing means.

5. An actuator according to claim 4 wherein the biasing means comprises a coil spring enclosed within the housing.

* * * * *